US010391669B2

(12) United States Patent
Weinkötz

(10) Patent No.: US 10,391,669 B2
(45) Date of Patent: Aug. 27, 2019

(54) METHOD FOR THE PRODUCTION OF LIGNOCELLULOSE MATERIALS

(71) Applicant: BASF SE, Ludwigshafen (DE)

(72) Inventor: Stephan Weinkötz, Neustadt (DE)

(73) Assignee: BASF SE, Ludwigshafen am Rhein (DE)

( * ) Notice: Subject to any disclaimer, the term of this patent is extended or adjusted under 35 U.S.C. 154(b) by 541 days.

(21) Appl. No.: 15/110,528

(22) PCT Filed: Jan. 9, 2015

(86) PCT No.: PCT/EP2015/050279

§ 371 (c)(1),
(2) Date: Oct. 10, 2016

(87) PCT Pub. No.: WO2015/104349

PCT Pub. Date: Jul. 16, 2015

(65) Prior Publication Data

US 2017/0021525 A1 Jan. 26, 2017

(30) Foreign Application Priority Data

Jan. 13, 2014 (EP) ..... 14150992

(51) Int. Cl.

| | |
|---|---|
| ***B27N 3/00*** | (2006.01) |
| ***B27N 3/02*** | (2006.01) |
| ***B27N 3/04*** | (2006.01) |
| ***B27N 3/08*** | (2006.01) |
| ***B27N 3/18*** | (2006.01) |

(52) U.S. Cl.

CPC ..... *B27N 3/08* (2013.01); *B27N 3/002* (2013.01); *B27N 3/005* (2013.01); *B27N 3/02* (2013.01); *B27N 3/04* (2013.01); *B27N 3/083* (2013.01); *B27N 3/18* (2013.01)

(58) Field of Classification Search

None

See application file for complete search history.

(56) References Cited

U.S. PATENT DOCUMENTS

| | | | | |
|---|---|---|---|---|
| 5,112,875 | A | 5/1992 | Zimmermann et al. | |
| 5,401,582 | A | 3/1995 | Weyland et al. | |
| 5,913,990 | A | 6/1999 | Kramer | |
| 6,348,530 | B1 | 2/2002 | Reck et al. | |
| 6,841,608 | B1 | 1/2005 | Dreher et al. | |
| 2011/0039090 | A1* | 2/2011 | Weinkotz | B27N 3/005 428/313.5 |
| 2012/0083554 | A1* | 4/2012 | Combs | B27N 3/002 524/9 |
| 2012/0138224 | A1 | 6/2012 | Peretolchin et al. | |
| 2013/0089700 | A1* | 4/2013 | Hurst | C08K 11/00 428/112 |
| 2013/0177757 | A1* | 7/2013 | Weinkotz | B32B 21/02 428/313.5 |
| 2013/0183517 | A1* | 7/2013 | Weinkotz | B32B 21/02 428/313.5 |

FOREIGN PATENT DOCUMENTS

| | | | |
|---|---|---|---|
| CA | 2854701 | A1 | 6/2013 |
| DE | 40 03 422 | A1 | 8/1991 |
| DE | 19949592 | A1 | 4/2001 |
| DE | 10315922 | A1 | 11/2004 |
| EP | 1240205 | A1 | 9/2002 |
| WO | WO-9201540 | A1 | 2/1992 |
| WO | WO-97/28936 | A1 | 8/1997 |
| WO | WO-99/02591 | A1 | 1/1999 |
| WO | WO-0127163 | A1 | 4/2001 |
| WO | WO-2011018373 | A1 | 2/2011 |
| WO | WO-2012/018934 | A1 | 2/2012 |
| WO | WO-2013092817 | A1 | 6/2013 |

OTHER PUBLICATIONS

Internatinonal Preliminary Examination Report with Written Opinion of the International Searching Authority and Applicant response for PCT/EP2015/050279 dated Dec. 22, 2015.

International Search Report for PCT/EP2015/050279 dated Jul. 24, 2015.

* cited by examiner

*Primary Examiner* — Mary Lynn F Theisen

(74) *Attorney, Agent, or Firm* — Drinker Biddle & Reath LLP

(57) ABSTRACT

The present invention relates to a process for the production of lignocellulose materials via mixing A) of lignocellulose-containing particles or fibers, B) with organic isocyanate having at least two isocyanate groups or a mixture of these, and optionally with C) binders selected from the group of the phenol-formaldehyde resins, the aminoplastic resins, the protein-based binders, and other polymer-based binders, and mixtures of these, D) additives or a mixture of these, and E) plastics particles or a mixture of these, with the steps of:

i.) scattering of the resultant mixture to give a mat, ii.) precompaction and heating of the mat during or after the precompaction process, and iii.) then hot pressing, wherein, in the step ii.), operations are carried out at elevated temperature during and/or after the precompaction process, and a value of at least 4 cm is achieved for the resultant mat in the push-off test.

21 Claims, No Drawings

METHOD FOR THE PRODUCTION OF LIGNOCELLULOSE MATERIALS

CROSS-REFERENCE TO RELATED APPLICATIONS

This application is a national stage application (under 35 U.S.C. § 371) of PCT/EP2015/050279, filed Jan. 9, 2015, which claims benefit of European Application No. 14150992.7, filed Jan. 13, 2014, both of which are incorporated herein by reference in their entirety.

The present invention relates to a process for the production of lignocellulose materials by carrying out operations at elevated temperature during and/or after the precompaction process, but before the hot-pressing procedure.

In the production of lignocellulose-containing composites (hereinafter also termed lignocellulose materials) such as medium-density fiberboard (MDF), high-density fiberboard (HDF), particleboard (PB), or oriented strand boards (OSB), a binder or a binder formulation is admixed with lignocellulose particles or lignocellulose fibers. The binder or the binder formulation here is by way of example sprayed in a blender or similar apparatus onto the lignocellulose particles or lignocellulose fibers. Another possibility is the addition of the binder or the binder formulation to lignocellulose fibers in what is known as the blowline. After the application of the binder or of the binder formulation, the lignocellulose particles or lignocellulose fibers are scattered to give a mat. This is first precompacted in order to increase the stability of the mat. The mat is then compacted in a hot press to give a board. Usual pressing temperatures are from 120 to 250° C.

Binders or binder components often used in the binder formulation are urea-formaldehyde resins (UFs), urea-melamine formaldehyde resins (MUFs), phenol-formaldehyde resins (PFs), or isocyanates. Lignocellulose-containing composites which are produced with isocyanate-containing binders feature high strength values and high moisture resistance. Other advantages are good processing properties, high flexibility in respect of hardening temperature, and of process conditions, and high tolerance with regard to high moisture content of the particles or fibers. Furthermore, isocyanate-containing binders emit no formaldehyde.

It is known that polymeric diphenylmethane diisocyanate (polymeric MDI, or PMDI) can be used as binder or binder component for the production of lignocellulose-containing composites. It is also possible to use isocyanate prepolymers, e.g. made of polyols and PMDI.

Isocyanates have a decisive disadvantage in comparison with UF, MUF, and PF binders. They exhibit markedly lower initial adhesion. That means that after the particles or fibers have been scattered and precompacted they do not cohere sufficiently. The mat is therefore damaged by vibration, or in the worst case is completely unsuitable for certain steps in the production process. A critical step is by way of example in the case of continuous plants the transfer to the hot press by a conveyor belt on which the mat is scattered and which conveys the mat through the prepress. The conveyor belt transfers the mat directly onto the lower steel belt of a continuous twin-belt press (e.g. Conti-Roll® from Siempelkamp). It has to withstand lack of support over a certain distance here. Problems frequently occur with isocyanate-bound boards because, by virtue of the low initial adhesion, the mat does not have adequate stability and cannot support its own weight. Particles fall from the material, causing losses of material and/or quality problems. In the worst case, the entire mat is destroyed at this point and production of particleboard is impossible. In discontinuously operating single- or multi-daylight presses (e.g. Class1Press from Dieffenbacher), again the mat has to be transferred, after the prepressing process and before the hot press, from one conveyor belt to the next, crossing a gap. Here again there are problems (loss of material, quality problems, scrap), because mats made of isocyanate-glued particles have inadequate initial adhesion.

WO-A-2011/018373 discloses a process for the production of a lightweight lignocellulose-containing material in which binders selected from the group consisting of aminoplastic resin, phenol-formaldehyde resin, and organic isocyanate having at least two isocyanate groups are used and particle cake, in this case having three layers, is precompacted while cold (generally at room temperature) and then hot-pressed.

This process is not entirely satisfactory because the precompacted particle cake does not have sufficient stability for further processing, in particular when organic isocyanates are used as binders.

WO-A-2012/018934 discloses a process for the production of composites in which the initial adhesion of binders such as PMDI is improved by adding tackifiers. By way of example, addition of polyethyleneimine can improve initial adhesion in a mat made of particles with which PMDI has been admixed. This method can achieve initial adhesion which is at least as great as when a UF glue is used as binder for the particles. This process has the disadvantage that the addition of tackifier markedly increases the costs for production of the boards, because the tackifier is used in addition to the binder. Furthermore, the tackifier can adversely affect the mechanical strength values and other properties of the wood-based board, which is produced by a hot pressing process. WO-A-2012/018934 provides no relevant information here.

WO-A-97/28936 discloses a process in which a large increase in productivity can be achieved in the production of board made of lignocellulose-containing material simply by slight heating of the mat, to a temperature below 60° C., in particular from 45 to 55° C. At these comparatively low temperatures there is also no undesired condensation of water or binder at the prepress, even if the composition of the binders has not been specifically matched to the process.

That process has the disadvantage that it does not function at temperatures above 60° C. Nothing is said moreover about the stability of the resultant precompacted mat. Furthermore, WO-A-97/28936 does not say whether the process can be used for multilayer boards. Only urea resins and polyurethane resins are described as possible binders.

It was therefore an object of the present invention to eliminate the abovementioned disadvantages, and in particular to develop a low-cost process for the production of a lignocellulose material (particleboard, OSB, MDF, HDF)

- with use of isocyanate-containing binders,
  - in which, despite the low initial adhesion of said binders, a stable mat is obtained after the prepress,
  - which withstands the mechanical loads experienced in the process,
  - where there is no adverse effect on the mechanical properties of the final board after the hot press.

Accordingly, a novel and improved process has been found for the production of lignocellulose materials via mixing A) of lignocellulose-containing particles or fibers, B) with organic isocyanate having at least two isocyanate groups or a mixture of these, and optionally with C) binders selected from the group of the phenol-formaldehyde resins, the aminoplastic resins, the protein-based binders, and other polymer-based binders, and mixtures of these, D) additives or a mixture of these, and E) plastics particles or a mixture of these, with the steps of:

i.) scattering of the resultant mixture to give a mat, ii.) precompaction and heating of the mat during or after the precompaction process, and iii.) then hot pressing, which comprises, in the step ii.), carrying out operations at elevated temperature during and/or after the precompaction process, and achieving a value of at least 4 cm for the resultant mat in the push-off test.

The process of the invention can be carried out as follows:

The comminuted and optionally or preferably dried lignocellulose parts, preferably wood parts, can, as required by the lignocellulose material that is to be produced, optionally be freed to some extent or very substantially from coarse and fine fractions. This can be achieved by sieving or sifting in the air stream. From 65 to 99% by weight, preferably from 80 to 98.5% by weight, particularly preferably from 85 to 98.25% by weight, in particular from 90 to 98% by weight, of said comminuted lignocellulose parts selected from the group of the lignocellulose-containing particles or fibers (component A), where one or more types of lignocellulose-containing particles or fibers can be selected, can be mixed with B) from 1 to 10% by weight, preferably from 1.5 to 5% by weight, particularly preferably from 1.75 to 4% by weight, in particular from 2 to 3.5% by weight, of one or more organic isocyanates having at least two isocyanate groups, or a mixture of these (component B), C) from 0 to 5% by weight, preferably from 0 to 4% by weight, particularly preferably from 0 to 3% by weight, in particular from 0 to 2% by weight, of binders selected from the group of the phenol-formaldehyde resins, the arninoplastic resins, the protein-based binders, and other polymer-based binders, or a mixture of these (component C), D) from 0 to 10% by weight, preferably from 0.5 to 8% by weight, particularly preferably from 1 to 6% by weight, in particular from 2 to 5% by weight, of additives or a mixture of these (component D), E) from 0 to 10% by weight, preferably from 0 to 8% by weight, particularly preferably from 0.5 to 6% by weight, in particular from 1 to 5% by weight, of plastics particles or a mixture of these (component E), in any desired sequence.

The process of the invention can produce single-layer or multilayer lignocellulose materials, preferably single-layer or multilayer particle- or fiberboard, particularly preferably single- or multilayer particleboard, very particularly preferably multilayer particleboard, in particular three-layer particleboard.

In the case of multilayer structures, all of the layers can have the same composition. It is preferable that the layers have different compositions. The quantitative proportions stated in the text (in % by weight) are always based on the composition of the entire material.

For each layer, the lignocellulose-containing materials A) or the mixtures of the lignocellulose-containing materials with the organic isocyanates B) and with components C), D), and E), or with the component constituents comprised therein (=plurality of constituents, e.g. materials or compounds from the group of one component) can be mixed in any desired sequence. Components A), B), C), D), and E) can respectively be composed of one, two ($A_1$, $A_2$ and $B_1$, $B_2$, and $C_1$, $C_2$, and $D_1$, $D_2$ and $E_1$, $E_2$), or more component constituents ($A_1$, $A_2$, $A_3$, . . . , and $B_1$, $B_2$, $B_3$, . . . , $C_1$, $C_2$, $C_3$, . . . , and $D_1$, $D_2$, $D_3$, . . . , and $E_1$, $E_2$, $E_3$).

It is preferable first to add the plastics particles E) to the lignocellulose-containing materials A), and then to admix this mixture with one or more binders from the group of components B) and C) ($B_1$, $B_2$, $C_1$, $C_2$). If two or more binders or binder constituents are used, these are preferably added separately from one another. In the case of separate addition, said component constituents can be added in direct succession or else at different junctures that do not follow one another directly. That means by way of example in the case where component C) is composed of two constituents $C_1$ and $C_2$, that $C_2$ is added immediately after $C_1$ or $C_1$ directly after $C_2$, or that between the addition of $C_1$ and $C_2$ one or more other components or component constituents, for example component B), are added. It is also possible, before components or component constituents are added, to premix them with other components or component constituents. By way of example, an additive constituent $D_1$ can be added to the binder C or to the binder constituent $C_1$ before this mixture is then added to the actual mixture.

It is preferable that the additives D) are mixed to some extent with the binder B) or C) or with a binder constituent $B_1$, $B_2$, . . . , $C_1$, $C_2$, . . . , and then added.

If the lignocellulose material is composed of a plurality of layers, the components for the individual layers are generally mixed separately from one another. Preference is given to a three-layer structure in which the composition of the inner layer differs from the two outer layers. The ratio of the total dry mass of the inner layer to the total dry mass of the two outer layers is generally from 100:1 to 0.25:1, preferably from 10:1 to 0.5:1, particularly preferably from 6:1 to 0.75:1, in particular from 4:1 to 1:1. The ratio of the total dry mass of the upper outer layer to the total dry mass of the lower outer layer is from 70:30 to 30:70, preferably from 60:40 to 40:60, particularly preferably from 55:45 to 45:55, very particularly preferably from 52:48 to 48:52.

In one particular embodiment, it is only the inner layer(s) that comprise(s) plastics particles E).

The % by weight data for components A) to E) relate to the dry weights of the respective component, based on total dry weight. The sum of the % by weight data for components A) to E) is 100% by weight. All of the layers also comprise water, which is ignored in the weight data. The water can derive from the residual moisture comprised in the lignocellulose-containing particles or fibers, from the binders, for example if the isocyanate-containing binder takes the form of aqueous emulsion, from additionally added water, for example for the dilution of the binders or for the moistening of the outer layers, from the additives, for example aqueous hardener solutions or aqueous paraffin emulsions, or from the expanded plastics particles if these by way of example are foamed by steam. The water content of the individual layers can be up to 20% by weight, i.e, from 0 to 20% by weight, preferably from 2 to 15% by weight, particularly preferably from 4 to 10% by weight, based on 100% by weight of total dry weight.

The dry weight of an aminoplastic resin or of a phenol-formaldehyde resin in aqueous suspension can be determined in accordance with Günter Zeppenfeld, Dirk Grunwald, Klebstoffe in der Holz-und Möbelindustrie [Adhesives in the Wood and Furniture Industry], 2nd edition, DRW-Verlag, p. 268. The dry weight of aminoplastic resins (or phenol-formaldehyde resins) is determined by weighing 1 g of resin accurately into a balance pan, distributing it finely on the pan base, and drying at 120° C. for 2 hours in a drying oven. After cooling to room temperature in a dessicator, the weight of the residue is taken and calculated as percentage proportion of the input weight.

Step i.):

The mixtures A) to E) are scattered to give a mat. The mixtures are generally directly scattered onto a molding belt. If the lignocellulose material has a multilayer structure, different mixtures A) to E) with different compositions are scattered directly on top of one another. The person skilled in the art is aware of various scattering methods, for example mechanical scattering, e.g. using roller systems, and pneumatic scattering, these being described by way of example in M. Dunky, P. Niemz, Holzwerkstoffe und Leime [Wood-based materials and Glues], pp. 119-121, Springer Verlag Heidelberg, 2002). The scattering process can take place either in cycles or continuously.

In one particular embodiment for the production of a three-layer particleboard, the materials scattered onto the molding belt are firstly the outer-layer material comprising components A), B), optionally C), and optionally D), then the middle-layer material—comprising components A), B), optionally C), optionally D), and optionally E)—and finally again outer-layer material.

In one very particular embodiment for the production of a three-layer particleboard, the materials scattered onto the molding belt are firstly the outer-layer material comprising components A), B), and optionally D), the middle-layer material—comprising components A), B), and optionally D)—and finally again outer-layer material.

In one particularly preferred embodiment, the underside and/or upper side of the mat is brought into contact, before or during the step ii.), with water or an aqueous solution, emulsion, or suspension of a component F). It is preferable that underside and upper side are brought into contact with water or an aqueous solution, emulsion, or suspension of a component F). This can by way of example be achieved in that, after the scattering process and before the precompaction process, or optionally after the scattering process and the cold precompaction process and before the heating process (this being an option that can be selected when the heating process takes place after the precompaction process) from 5 to 200 g/m$^2$, preferably from 10 to 100 g/m$^2$, particularly preferably from 15 to 60 g/m$^2$, of water or aqueous solution, emulsion, or suspension of component F) are applied onto the upper side of the mat. The mat is then turned so that the original underside is then upward. From 5 to 200 g/m$^2$, preferably from 10 to 100 g/m$^2$, particularly preferably from 15 to 60 g/m$^2$, of water or aqueous solution, emulsion, or suspension of component F) are then applied onto the new upper side, i.e. the original underside. Another method for bringing underside and upper side of the mat into contact with water or an aqueous solution, emulsion, or suspension of a component F) consists in applying, before the scattering process, onto the molding belt, from 5 to 200 g/m$^2$, preferably from 10 to 100 g/m$^2$, particularly preferably from 15 to 60 g/m$^2$, of water or aqueous solution, emulsion, or suspension of component F) and, after the scattering process, applying from 5 to 200 g/m$^2$, preferably from 10 to 100 g/m$^2$, particularly preferably from 15 to 60 g/m$^2$, of water or of an aqueous solution, emulsion, or suspension of component F) onto the scattered mat. The application of the water or of the aqueous solution, emulsion, or suspension of a component F) onto the molding belt or onto the surface of the mat is achieved via droplet application, roll application, cast application, or spraying, preferably by spraying.

Step ii.):

The scattered mat is then precompacted and heated. The heating to elevated temperature takes place either during or after the precompaction process, preferably during the precompaction process. The expression elevated temperature means temperatures above room temperature, preferably from 40 to 100° C., particularly preferably from 55 to 90° C., in particular from 60 to 80° C., very particularly preferably from 65 to 80° C. The method for heating during the precompaction process or after the precompaction process is such that the height of the mat at the juncture at which the final temperature of said heating process is reached in the center of the mat is from 20 to 80% of the height of the mat immediately after the scattering of the mat, preferably from 25 to 70%, particularly preferably from 27.5 to 60%, very particularly preferably from 30 to 50%. The average temperature in the center of the mat after the precompaction process and heating process is generally at least 40° C., preferably at least 55° C., particularly preferably at least 60° C., very particularly preferably at least 65° C., and at most 100° C., preferably at most 90° C., and particularly preferably at most 80° C. In one particular embodiment, the heat is introduced within a period of 60 seconds to reach said temperature, preferably 40 seconds, particularly preferably 20 seconds, very particularly preferably within 10 seconds. The process of the invention leads to a stable mat which has high stabililty despite the known poor initial adhesion of isocyanate-containing binders, and which can thus, without support, bridge gaps between individual belts in the production process.

When the expression "center of the mat" is used here it means the layer in the mat that comprises 10% of the entire mass of the board and that is delimited by an upper delimiting area running parallel to the upper surface of the mat and by a lower delimiting area running parallel to the lower surface of the mat, where the distance between the upper delimiting area and the upper surface of the mat is the same as the distance between the lower delimiting area and the lower surface of the mat.

The energy in the step ii.) can be introduced by using one or more energy sources of any type. Suitable energy sources are hot air, steam, vapor/air mixtures, or electrical energy (high-frequency high-voltage field or microwaves), preferably electrical energy, particularly preferably high-frequency high-voltage field.

In one particularly preferred embodiment, heating is achieved during the precompaction process by applying a high-frequency high-voltage field. This procedure can take place either in a continuous process or in a batch process. An apparatus for a continuous process for achieving the heating during the precompaction process is described by way of example in WO-A-97/28936. Heating during the precompaction process can also take place in a batchwise-operating high-frequency press, e.g. in a high-frequency press, for example in the HLOP 170 press from Hoefer Presstechnik GmbH.

If the heating takes place after the precompaction process, expansion of the mat during heating can be prevented by carrying out the heating in an upwardly and downwardly delimited space. The design of the delimiting areas here is such as to permit introduction of energy. By way of example, perforated plastics belts or steel nets can be used which are permeable to hot air, steam, or steam-air mixtures. The design of the delimiting areas is optionally such that they exert a pressure on the mat, said pressure being sufficiently great to prevent expansion during heating.

Step iii.):

The precompacted and preheated mat is usually pressed at temperatures of from 80 to 300° C., preferably from 120 to 280° C., particularly preferably from 150 to 250° C., and at pressures of from 1 to 50 bar, preferably from 3 to 40 bar, particularly preferably from 5 to 30 bar, to give the desired thickness of lignocellulose materials. The pressing process can use any of the processes known to the person skilled in the art (see examples in "Taschenbuch der Spanplatten Technik" [Handbook of Particleboard Technology] H.-J. Deppe, K. Ernst, 4th edn., 2000, DRW-Verlag Weinbrenner, Leinfelden-Echterdingen, pp. 232 to 254, and "MDF—Mitteldichte Faserplatten" [MDF—Medium-Density Fiberboard] H.-J. Deppe, K. Ernst, 1996, DRW-Verlag Weinbrenner, Leinfelden-Echterdingen, pp. 93 to 104). Press processes used here are batch processes, for example in single- or multi-daylight presses, or continuous press processes, for example in twin-belt presses. Press time is normally from 3 to 15 seconds per mm of board thickness.

Component A): Lignocellulose-Containing Materials

Lignocellulose-containing materials are materials which comprise lignified plant material. Lignification is the chemical and physical alteration of the cell walls of plants due to deposition of lignin. The most important lignocellulose-containing material is wood, but it is also possible to use other plants which comprise lignin, or agricultural and arboricultural feedstocks which comprise lignin, or agricultural and arboricultural raw materials and residues which comprise lignin, e.g. straw, flax shives, or cotton stems. Other suitable materials are palms or grasses with lignified stems, for example bamboo. Another source of lignocellulose-containing materials is used paper or used timber, for example used furniture. The lignocellulose-containing materials used can comprise foreign materials which do not derive from lignocellulose-containing plants. The content of foreign materials can vary widely and is generally from 0 to 30% by weight, preferably from 0 to 10% by weight, particularly preferably from 0 to 5% by weight, in particular from 0 to 1% by weight. Foreign materials can be plastics, adhesives, coatings, dyes, etc. which by way of example are comprised in used timber. The term lignocellulose is known to the person skilled in the art.

It is possible to use one lignocellulose-containing material or a plurality thereof. The expression "a plurality of lignocellulose-containing materials" generally means from 2 to 10, preferably from 2 to 5, particularly preferably from 2 to 4, in particular from 2 or 3, different lignocellulose-containing materials.

The lignocellulose-containing materials are used in the form of fibers or particles such as strips, chips, dust, or a mixture of these, preferably chips, fibers, dust, or a mixture of these, particularly preferably chips, fibers, or a mixture of these. The fibers or particles are generally produced from starting materials via comminution. Suitable starting materials are usually lignocellulose-containing plants and plant parts. Examples of suitable plants are trees, grasses, flax, hemp, or a mixture of these, preferably trees.

The following are preferably used as lignocellulose-containing materials: wood fibers or wood particles, such as wood layers, wood strips, sawdust, wood chips, shavings, wood dust, or a mixture of these, preferably wood chips, wood fibers, wood dust, or a mixture of these, particularly preferably wood chips, wood fibers, or a mixture of these.

Species of wood that can be used for the production of the wood particles or wood fibers are any desired coniferous or deciduous species, inter alia from industrial timber residues, timber from forest-thinning, or plantation timber, preferably wood from eucalyptus, spruce, beech, pine, larch, lime, poplar, ash, oak, or fir, or a mixture of these, particularly preferably from eucalyptus, spruce, pine, and beech, or a mixture of these, in particular eucalyptus, pine, and spruce, or a mixture of these.

The dimensions of the comminuted lignocellulose-containing materials are not critical, and depend on the lignocellulose material to be produced.

Large chips used by way of example for the production of OSB are also called strands. The average size of the strands is generally from 20 to 300 mm, preferably from 25 to 200 mm, particularly preferably from 30 to 150 mm.

Production of particle board generally uses relatively small chips. The particles required for this can be classified according to size by means of sieve analysis. Sieve analysis is described by way of example in DIN 4188 or DIN ISO 3310. The average size of the particles is generally from 0.01 to 30 mm, preferably from 0.05 to 25 mm, particularly preferably from 0.1 to 20 mm.

Suitable fibers are wood fibers, cellulose fibers, hemp fibers, cotton fibers, bamboo fibers, miscanthus, bagass (sugar cane), or a mixture of these, preferably wood fibers, hemp fibers, bamboo fibers, miscanthus, bagass, or a mixture of these, particularly preferably wood fibers, or a mixture of these. The length of the fibers is generally from 0.01 to 20 mm, preferably from 0.05 to 15 mm, particularly preferably from 0.1 to 10 mm.

Processes known per se can be used to comminute the lignocellulose-containing materials to give lignocellulose-containing particles or fibers (see for example: M. Dunky, P. Niemz, Holzwerkstoffe und Leime [Wood-based Materials and Glues], pp. 91 to 156, Springer Verlag Heidelberg, 2002).

Usual drying methods known to the person skilled in the art can be used to obtain the lignocellulose-containing materials with the small quantities of water that are usual after said drying (within a usual narrow range of variation; known as "residual moisture"); this water is ignored in the weight data in the present invention.

The average density of the lignocellulose-containing starting materials of the invention from which the lignocellulose-containing particles or fibers are produced is as desired, and is generally from 0.2 to 0.9 g/cm$^3$, preferably from 0.4 to 0.85 g/cm$^3$, particularly preferably from 0.4 to 0.75 g/cm$^3$, in particular from 0.4 to 0.6 g/cm$^3$. Density here means the envelope density as defined in DIN 1306 under standard atmospheric conditions (20° C./65% humidity), i.e. inclusive of the cavities comprised in the lignocellulose-containing starting material, e.g. the trunk.

Component B): Organic Isocyanates

Suitable organic isocyanates are organic isocyanates having at least two isocyanate groups, or a mixture of these, in particular any of the organic isocyanates known to the person skilled in the art, preferably those for the reproduction of wood-based materials or of polyurethanes, or a mixture of these isocyanates. Organic isocyanates of this type, and also production and use thereof, are described by way of example in Becker/Braun, Kunststoff Handbuch [Plastics Handbook], 3rd revised edition, volume 7 "Polyurethane" [Polyurethanes], Hanser 1993, pp. 17 to 21, pp. 76 to 88, and pp. 665 to 671.

Preferred organic isocyanates are oligomeric isocyanates having from 2 to 10, preferably from 2 to 8, monomer units and on average at least one isocyanate group per monomer unit, or a mixture of these. The isocyanates can be aliphatic, cycloaliphatic, or aromatic. Particular preference is given to the organic isocyanate MDI (methylenediphenyl diisocyanate), the oligomeric organic isocyanate PMDI (polymeric methylenediphenylene diisocyanate), these being obtainable via condensation of formaldehyde with aniline and phosgenation of the isomers and oligomers produced in the condensation reaction (see by way of example Becker/Braun, Kunststoff Handbuch [Plastics Handbook], 3rd revised edition, volume 7 "Polyurethane" [Polyurethanes], Hanser 1993, p. 18 final paragraph top. 19, second paragraph, and p. 76, fifth paragraph), or a mixture of MDI and PMDL Very particular preference is given to products from the LUPRANAT® line from BASF SE, in particular from LUPRANAT® M 20 FB from BASF SE.

The organic isocyanate can also be an isocyanate-terminated prepolymer which is the reaction product of an isocyanate, e.g. PMDI, with one or more polyols and/or polyamines.

Polyols selected from the group of ethylene glycol, diethylene glycol, propylene glycol, dipropylene glycol, butanediol, glycerol, trimethylolpropane, triethanolamine, pentaerythritol, sorbitol, and mixtures thereof can be used. Other suitable polyols are biopolyols, such as polyols derived from soya oil, rapeseed oil, castor oil, and sunflower oil. Other suitable materials are polyether polyols which can be obtained via polymerization of cyclic oxides, for example ethylene oxide, propylene oxide, butylene oxide, or tetrahydrofuran in the presence of polyfunctional initiators. Suitable initiators comprise active hydrogen atoms, and can be water, butanediol, ethylene glycol, propylene glycol, diethylene glycol, triethylene glycol, dipropylene glycol, ethanolamine, diethanolamine, triethanolamine, toluenediamine, diethyltoluenediamine, phenyldiamine, diphenylmethanediamine, ethylenediamine, cyclohexanediamine, cylcohexanedimethanol, resorcinol, bisphenol A, glycerol, trimethylolpropane, 1,2,6-hexanetriol, pentaerythritol, or any mixture thereof. Other suitable polyether polyols comprise diols and triols such as polyoxypropylenediols and -triols, and poly(oxyethylene-oxypropylene)diols and -triols, these being produced via simultaneous or successive addition reactions of ethylene oxides and propylene oxides with di- or trifunctional initiators. Other suitable materials are polyester polyols such as hydroxy-terminated reaction products of polyols as described above with polycarboxylic acids or polycarboxylic acid derivatives, e.g. anhydrides thereof, in particular dicarboxylic acids or dicarboxylic acid derivatives, for example succinic acid, dimethyl succinate, glutaric acid, dimethyl glutarate, adipic acid, dimethyl adipate, sebacic acid, phthalic anhydride, tetrachlorophthalic anhydride, or dimethyl terephthalate, or a mixture thereof.

Polyamines selected from the group of ethylenediamine, toluenediamine, diaminodiphenylmethane, polymethylene polyphenyl polyamines, amino alcohols, and mixtures thereof can be used. Examples of amino alcohols are ethanolamine and diethanolamine.

The organic isocyanate or the isocyanate-terminated prepolymer can also be used in the form of an aqueous emulsion which is produced by way of example via mixing with water in the presence of an emulsifier. The organic isocyanate or the isocyanate component of the prepolymer can also be modified isocyanates, for example carbodiimides, allophanates, isocyanurates, and biurets.

Component C)

Component C) is binders selected from the group of the phenol-formaldehyde resins, the aminoplastic resins, the protein-based binders, and other polymer-based binders, or a mixture of these.

Phenol-Formaldehyde Resins

Phenol-formaldehyde resins (also termed PF resins) are known to the person skilled in the art, see by way of example Kunststoff-Handbuch [Plastics Handbook], 2nd edn., Hanser 1988, vol. 10 "Duroplaste" [Thermosets], pp. 12 to 40.

Aminoplastic Resins

Aminoplastic resins used can be any of the aminoplastic resins known to the person skilled in the art, preferably for the production of wood-based materials. These resins, and also production thereof, are described by way of example in Ullmanns Enzyklopädie der technischen Chemie [Ullmann's Encyclopedia of Industrial Chemistry], 4th revised and extended edition, Verlag Chemie, 1973, pp. 403 to 424 "Aminoplaste" [Aminoplastics] and Ullmann's Encyclopedia of Industrial Chemistry, vol. A2, VCH Verlagsgesellschaft, 1985, pp. 115 to 141 "Amino Resins", and also in M. Dunky, P. Niemz, Holzwerkstoffe und Leime [Wood-based Materials and Glues], Springer 2002, pp. 251 to 259 (UF resins) and pp. 303 to 313 (MUF and UF with small quantity of melamine), and can be produced via reaction of the compounds comprising carbamide groups, preferably urea, melamine, or a mixture of these, with the aldehydes, preferably formaldehyde, in the desired molar ratios of carbamide group to the aldehyde, preferably in water as solvent.

The desired molar ratio of aldehyde, preferably formaldehyde, to the amino group optionally partially substituted by organic moieties can also be established via addition of monomers bearing $NH_2$ groups to finished aminoplastic resins that are relatively rich in formaldehyde. Monomers bearing NH2 groups are preferably urea, melamine, or a mixture of these, particularly preferably urea.

Preferred aminoplastic resins are polycondensates of compounds having at least one carbamide group optionally partially substituted by organic moieties (the carbamide group also being termed carboxamide group) and of an aldehyde, preferably formaldehyde. Particular preference is given to urea-formaldehyde resins (UF resins), melamine-formaldehyde resins (MF resins), or melamine-containing urea-formaldehyde resins (MUF resins), in particular urea-formaldehyde resins, for example Kaurit® glues from BASF SE. Aminoplastic resins to which very particular preference is further given are polycondensates of compounds having at least one amino group, inclusive of partial substitution by organic moieties, and aldehyde, where the molar ratio of aldehyde to amino group optionally partially substituted by organic moieties is in the range from 0.3:1 to 1:1, preferably from 0.3:1 to 0.6:1, particularly preferably from 0.3:1 to 0.45:1, very particularly preferably from 0.3:1 to 0.4:1. The calculation of this molar ratio includes aldehyde-containing additives, e.g. formaldehyde solution, and additives comprising amino groups, e.g. urea, where these are added to the aminoplastic resin prior to the application of the aminoplastic resin, or where these are applied separately.

The aminoplastic resins mentioned are usually used in liquid form, mostly in solution or suspension in a liquid medium, preferably in aqueous solution or suspension, or else as solid.

The solids content of the aminoplastic resin solution or suspension, preferably of the aqueous solution or suspension, is usually from 25 to 90% by weight, preferably from 50 to 70% by weight.

Protein-Based Binders

Examples of suitable protein-based binders are casein glues, animal glues, and blood albumin glues. It is also possible to use binders where alkaline-hydrolyzed proteins are used as binder constituent. Binders of this type are described in M. Dunky, P. Niemz, Holzwerkstoffe und Leime [Wood-based Materials and Glues], Springer 2002, pp. 415 to 417.

Soya-protein-based binders are particularly suitable. These binders are typically produced from soya flour. The soya flour can optionally be modified. The soya-based binder can take the form of dispersion. It comprises various functional groups, for example lysine, histidine, arginine, tyrosine, tryptophan, serine and/or cysteine. In one preferred embodiment the soya protein is copolymerized, e.g. with phenolic resin, urea resin, or PMDI. In one very particular embodiment the soya-based binder is composed of a combination of a polyamidoepichlorohydrin resin (PAE) with a soya-based binder. An example of a suitable binder is the commercially obtainable binder system Hercules® PTV D-41080 Resin (PAE resin) and PTV D-40999 (soya component).

Other Polymer-Based Binders

Suitable polymer-based binders are aqueous binders which comprise a polymer N composed of the following monomers:

a) from 70 to 100% by weight of at least one ethylenically unsaturated mono- and/or dicarboxylic acid (monomer(s) $N_1$) and
b) from 0 to 30% by weight of at least one other ethylenically unsaturated monomer which differs from the monomers $N_1$ (monomer(s) $N_2$), and optionally a low-molecular-weight crosslinking agent having at least two functional groups selected from the group of hydroxy, carboxylic acid and derivatives thereof, primary, secondary, and tertiary amine, epoxy, and aldehyde.

The production of polymers N is familiar to the person skilled in the art and in particular is achieved via free-radical-initiated solution polymerization for example in water or in an organic solvent (see by way of example A. Echte, Handbuch der Technischen Polymerchemie [Handbook of Industrial Polymer Chemistry], chapter 6, VCH, Weinheim, 1993 or B. Vollmert, Grundriss der Makromolekularen Chemie [Principles of Macromolecular Chemistry], vol. 1, E. Vollmert Verlag, Karlsruhe, 1988).

Particular monomers $N_1$ that can be used are α,β-monoethylenically unsaturated mono- and dicarboxylic acids having from 3 to 6 C atoms, possible anhydrides of these, and also water-soluble salts of these, in particular alkali metal salts of these, examples being acrylic acid, methacrylic acid, maleic acid, fumaric acid, itaconic acid, citraconic acid, tetrahydrophthalic acid, and anhydrides of these, for example maleic anhydride, and also the sodium or potassium salts of the abovementioned acids. Particular preference is given to acrylic acid, methacrylic acid, and/or maleic anhydride, and in particular preference is given here to acrylic acid and to the double combinations of acrylic acid and maleic anhydride, or acrylic acid and maleic acid.

Monomer(s) $N_2$ that can be used are ethylenically unsaturated compounds that are easily copolymerizable by a free-radical route with monomer(s) $N_1$, for example ethylene, $C_3$- to $C_{24}$-α-olefins, such as propene, 1-hexene, 1-octene, 1-decene; vinylaromatic monomers, such as styrene, α-methylstyrene, o-chlorostyrene, or vinyltoluenes; vinyl halides, such as vinyl chloride or vinylidene chloride; esters derived from vinyl alcohol and from monocarboxylic acids having from 1 to 18 C atoms, for example vinyl acetate, vinyl propionate, vinyl n-butyrate, vinyl laurate, and vinyl stearate; esters derived from α,β-monoethylenically unsaturated mono- and dicarboxylic acids having preferably from 3 to 6 C atoms, particular examples being acrylic acid, methacrylic acid, maleic acid, fumaric acid, and itaconic acid, with alkanols generally having from 1 to 12, preferably from 1 to 8, and in particular from 1 to 4, C atoms, particular examples being the methyl, ethyl, n-butyl, isobutyl, pentyl, hexyl, heptyl, octyl, nonyl, decyl, and 2-ethylhexyl esters of acrylic and of methacrylic acid, the dimethyl or di-n-butyl esters of fumaric and of maleic acid; nitriles of α,β-monoethylenically unsaturated carboxylic acids, for example acrylonitrile, methacrylonitrile, fumaronitrile, maleonitrile, and also $C_4$- to $C_8$-conjugated dienes, such as 1,3-butadiene and isoprene. The monomers mentioned generally form the main monomers, and these combine to form a proportion of >50% by weight, preferably >80% by weight, and particularly preferably >90% by weight, based on the entirety of the monomers $N_2$, or indeed form the entirety of the monomers $N_2$. The solubility of these monomers in water under standard conditions (20° C., 1 atm (absolute)) is very generally only moderate to low.

Other monomers $N_2$, which however have higher water-solubility under the abovementioned conditions, are those comprising at least one sulfonic acid group and/or anion corresponding thereto or at least one amino, amido, ureido, or N-heterocyclic group, and/or nitrogen-protonated or -alkylated ammonium derivatives thereof. Mention may be made of acrylamide and methacrylamide by way of example; and also of vinylsulfonic acid, 2-acrylamido-2-methylpropanesulfonic acid, styrenesulfonic acid, and water-soluble salts thereof, and also N-vinylpyrrolidone; 2-vinylpyridine, 4-vinylpyridine; 2-vinylimidazol; 2-(N,N-dimethylamino)ethyl acrylate, 2-(N,N-dimethylamino)ethyl methacrylate, 2-(N,N-diethylamino)ethyl acrylate, 2-(N,N-diethylamino)ethyl methacrylate, 2-(N-tert-butylamino) ethyl methacrylate, N-(3-N',N'-dimethylaminopropyl)methacrylamide, and 2-(1-imidazolin-2-onyl)ethyl methacrylate.

The abovementioned water-soluble monomers $N_2$ are usually comprised merely as modifying monomers in quantities of <10% by weight, preferably <5% by weight, and particularly preferably <3% by weight, based on the entirety of monomers $N_2$.

Further monomers $N_2$, where these usually increase the internal strength of the filmed polymer matrix, normally have at least one epoxy, hydroxy, N-methylol, or carbonyl group, or at least two non-conjugated ethylenically unsaturated double bonds. Examples here are monomers having two vinyl moieties, monomers having two vinylidene moieties, and also monomers having two alkenyl moieties, Particularly advantageous monomers here are the diester of dihydric alcohols with α,β-monoethylenically unsaturated monocarboxylic acids, and among these preference is given to acrylic acid and methacrylic acid. Examples of monomers of this type having two non-conjugated ethylenically unsaturated double bonds are alkylene glycol diacrylates and alkylene glycol dimethacrylates, for example ethylene glycol diacrylate, propylene 1,2-glycol diacrylate, propylene 1,3-glycol diacrylate, butylene 1,3-glycol diacrylate, butylene 1,4-glycol diacrylate and ethylene glycol dimethacrylate, propylene 1,2-glycol dimethacrylate, propylene 1,3-glycol dimethacrylate, butylene glycol 1,3-dimethacrylate, butylene glycol 1,4-dimethacrylate, and also divinylbenzene, vinyl methacrylate, vinyl acrylate, allyl methacrylate, allyl acrylate, diallyl maleate, diallyl fumarate, methylenebisacrylamide, cyclopentadienyl acrylate, triallyl cyanurate, and triallyl isocyanurate. Other materials of particular importance in this context are the $C_1$- to $C_8$-hydroxyalkyl esters of methacrylic and of acrylic acid, for example n-hydroxyethyl, n-hydroxypropyl, or n-hydroxybutyl acrylate and the corresponding methacrylate, and also compounds such as diacetoneacrylamide and acetylacetoxyethyl acrylate and the corresponding methacrylate.

Quantities used of the abovementioned crosslinking monomers $N_2$ are frequently<10% by weight, but preferably <5% by weight, based in each case on the entirety of monomers $N_2$. However, it is particularly preferable not to use any of these crosslinking monomers $N_2$ to produce the polymer N.

Preferred polymers N are obtainable via free-radical-initiated solution polymerization only of monomers $N_1$, particularly preferably of from 65 to 100% by weight, very particularly preferably from 70 to 90% by weight, of acrylic acid with particularly preferably from 0 to 35% by weight, very particularly preferably from 10 to 30% by weight, of maleic acid or maleic anhydride.

The weight-average molar mass $M_w$ of polymer N is advantageously from 1000 to 500 000 g/mol, preferably from 10 000 to 300 000 g/mol, particularly preferably from 30 000 to 120 000 g/mol.

Adjustment of the weight-average molar mass $M_w$ during the production of polymer N is familiar to the person skilled in the art, and is advantageously achieved via free-radical-initiated aqueous solution polymerization in the presence of compounds that provide free-radical-chain transfer, known as free-radical-chain regulators. Determination of the weight-average molar mass $M_w$ is also familiar to the person skilled in the art, and is achieved by way of example by means of gel permeation chromatography.

Commercially available products with good suitability for polymers N are by way of example the Sokalan® products from BASF SE, which are by way of example based on acrylic acid and/or maleic acid. WO-A-99/02591 describes other suitable polymers.

Crosslinking agents with good suitability are those with a (weight-average) molar mass in the range from 30 to 10 000 g/mol. The following may be mentioned by way of example: alkanolamines, such as triethanolamine; carboxylic acids, such as citric acid, tartaric acid, butanetetracarboxylic acid; alcohols, such as glucose, sucrose, or other sugars, glycerol, glycol, sorbitol, trimethylolpropane; epoxides, such as bisphenol A or bisphenol F, and also resins based thereon and moreover polyalkylene oxide glycidyl ethers or trirnethylolpropane triglycidyl ether. In one preferred embodiment of the invention the molar mass of the low-molecular-weight crosslinking agent used is in the range from 30 to 4000 g/mol, particularly preferably in the range from 30 to 500 g/mol.

Other suitable polymer-based binders are aqueous dispersions which comprise one or more polymers composed of the following monomers:

a. from 0 to 50% by weight of at least one ethylenically unsaturated monomer which comprises at least one epoxy group and/or at least one hydroxyalkyl group (monomer(s) $M_1$), and
b. from 50 to 100% by weight of at least one other ethylenically unsaturated monomer which differs from the monomers $M_1$ (monomer(s) $M_2$).

Polymer M is obtainable via free-radical-initiated emulsion polymerization of the appropriate monomers $M_1$ and/or $M_2$ in an aqueous medium. Polymer M can have one or more phases. Polymer M can have a core-shell structure.

The conduct of free-radical-initiated emulsion polymerization reactions of ethylenically unsaturated monomers in an aqueous medium has been widely described and is therefore well known to the person skilled in the art (see by way of example: Emulsion Polymerisation in Encyclopedia of Polymer Science and Engineering, vol. 8, pp. 659 if. (1987); D. C. Blackley, in High Polymer Latices, vol. 1, pp. 35 ff. (1966); H. Warson, The Applications of Synthetic Resin Emulsions, chapter 5, pp. 246 if. (1972); D. Diederich, Chemie in unserer Zeit 24, pp. 135 to 142 (1990); Emulsion Polymerisation, Interscience Publishers, New York (1965); DE-A 40 03 422, and Dispersionen Synthetischer Hochpolymerer [Dispersions of Synthetic High Polymers], F. Hölscher, Springer-Verlag, Berlin (1969)).

The procedure for the free-radical-initiated aqueous emulsion polymerization reactions is usually that the ethylenically unsaturated monomers are dispersed in the form of monomer droplets in the aqueous medium with concomitant use of dispersing agents, and are polymerized by means of a free-radical polymerization initiator.

Monomer(s) $M_1$ that can be used are in particular glycidyl acrylate and/or glycidyl methacrylate, and also hydroxyalkyl acrylates and the corresponding methacrylates, in both cases having $C_2$- to $C_{10}$-hydroxyalkyl groups, in particular $C_2$- to $C_4$-hydroxyalkyl groups, and preferably $C_2$- and $C_3$-hydroxyalkyl groups, for example 2-hydroxyethyl acrylate, 2-hydroxyethyl methacrylate, 3-hydroxypropyl acrylate, 3-hydroxypropyl methacrylate, 4-hydroxybutyl acrylate, and/or 4-hydroxybutyl methacrylate. It is particularly advantageous to use one or more, preferably one or two, of the following monomers $M_1$: 2-hydroxyethyl acrylate, 2-hydroxyethyl methacrylate, glycidyl acrylate, glycidyl methacrylate.

In the invention it is optionally possible to use some of, or the entirety of, monomers $M_1$ as initial charge in the polymerization vessel. However, it is also possible to meter the entirety or the optionally remaining residual quantity of monomers $M_1$ into the mixture during the polymerization reaction. The manner in which the entirety or the optionally remaining residual quantity of monomers $M_1$ is metered into the polymerization vessel here can be batchwise in one or more portions, or continuous with flow rates that remain the same or that alter. It is particularly advantageous that the metering of the monomers $M_1$ takes place continuously during the polymerization reaction, with flow rates that remain the same, in particular as constituent of an aqueous monomer emulsion.

Monomer(s) $M_2$ that can be used are in particular ethylenically unsaturated compounds that are easily copolymerizable with monomer(s) $M_1$ by a free-radical route, for example ethylene; vinylaromatic monomers such as styrene, α-methylstyrene, o-chlorostyrene, or vinyltoluenes; vinyl halides such as vinyl chloride or vinylidene chloride; esters derived from vinyl alcohol and from monocarboxylic acids having from 1 to 18 C atoms, for example vinyl acetate, vinyl propionate, vinyl n-butyrate, vinyl laurate, and vinyl stearate; esters derived from α,β-monoethylenically unsaturated mono- and dicarboxylic acids having preferably from 3 to 6 C atoms, particular examples being acrylic acid, methacrylic acid, maleic acid, fumaric acid, and itaconic acid, with alkanols generally having from 1 to 12, preferably from 1 to 8, and in particular from 1 to 4, C atoms, particular examples being the methyl, ethyl, n-butyl, isobutyl, pentyl, hexyl, heptyl, octyl, nonyl, decyl, and 2-ethylhexyl esters of acrylic and of methacrylic acid, the dimethyl or di-n-butyl esters of fumaric and of maleic acid; nitriles of α,β-monoethylenically unsaturated carboxylic acids, for example acrylonitrile, methacrylonitrile, fumaronitrile, maleonitrile, and also $C_4$- to $C_8$-conjugated dienes, such as 1,3-butadiene and isoprene. The monomers mentioned generally form the main monomers, and these combine to form a proportion of >50% by weight, preferably >80% by weight, and particularly >90% by weight, based on the entirety of the monomers $M_2$, or indeed form the entirety of the monomers $M_2$. The solubility of these monomers in water under standard conditions (20° C., 1 atm (absolute)) is very generally only moderate to low.

Monomers $M_2$ which have higher water solubility under the abovementioned conditions are those which comprise at least one acid group and/or acid group and/or anion corresponding thereto or at least one amino, amido, ureido, or N-heterocyclic group, and/or nitrogen-protonated or -alkylated ammonium derivatives thereof. Mention may be made by way of example of α,β-monoethylenically unsaturated mono- and dicarboxylic acids having from 3 to 6 C atoms and amides thereof, e.g. acrylic acid, methacrylic acid, maleic acid, fumaric acid, itaconic acid, acrylamide, and methacrylamide; and also of vinylsulfonic acid, 2-acrylamido-2-methylpropanesulfonic acid, styrenesulfonic acid, and water-soluble salts thereof, and also N-vinylpyrrolidone; 2-vinylpyridine, 4-vinylpyridine; 2-vinylimidazol; 2-(N,N-dimethylamino)ethyl acrylate, 2-(N,N-dimethylamino)ethyl methacrylate, 2-(N,N-diethylamino)ethyl acrylate, 2-(N,N-diethylamino)ethyl methacrylate, 2-(N-tert-butylamino)ethyl methacrylate, dimethylaminopropyl) methacrylamide, and 2-(1-imidazolin-2-onyl)ethyl methacrylate and ureido methacrylate. The abovementioned water-soluble monomers $M_2$ are usually comprised merely as modifying monomers in quantities of <10% by weight, preferably <5% by weight, and particularly preferably <3% by weight, based on the entirety of monomers $M_2$.

Monomers $M_2$, which usually increase the internal strength of the filmed polymer matrix, normally have at least one N-methylol, or carbonyl group, or at least two non-conjugated ethylenically unsaturated double bonds. Examples here are monomers having two vinyl moieties, monomers having two vinylidene moieties, and also monomers having two alkenyl moieties. Particularly advantageous monomers here are the diester of dihydric alcohols with α,β-monoethylenically unsaturated monocarboxylic acids, and among these preference is given to acrylic and methacrylic acid. Examples of monomers of this type having two non-conjugated ethylenically unsaturated double bonds are alkylene glycol diacrylates and alkylene glycol dimethacrylates, for example ethylene glycol diacrylate, propylene 1,2-glycol diacrylate, propylene 1,3-glycol diacrylate, butylene 1,3-glycol diacrylate, butylene 1,4-glycol diacrylate and ethylene glycol dimethacrylate, propylene 1,2-glycol dimethacrylate, propylene 1,3-glycol dimethacrylate, butylene glycol 1,3-dimethacrylate, butylene glycol 1,4-dimethacrylate, and also divinylbenzene, vinyl methacrylate, vinyl acrylate, allyl methacrylate, allyl acrylate, diallyl maleate, diallyl fumarate, methylenebisacrylamide, cyclopentadienyl acrylate, triallyl cyanurate, and triallyl isocyanurate. Examples of other compounds of importance in this context are diacetoneacrylamide and acetylacetoxyethyl acrylate and the corresponding methacrylate. Quantities used of the abovementioned crosslinking monomers $M_2$ are frequently<10% by weight, preferably <5% by weight, and particularly preferably <3% by weight, each based on the entirety of monomers $M_2$. However, the quantity of these crosslinking monomers $M_2$ used is frequently zero.

In the invention it is optionally possible to use some of, or the entirety of, monomers $M_2$ as initial charge in the polymerization vessel. However, it is also possible to meter the entirety or the optionally remaining residual quantity of monomers $M_2$ into the mixture during the polymerization reaction. The manner in which the entirety or the optionally remaining residual quantity of monomers $M_2$ is metered into the polymerization vessel here can be batchwise in one or more portions, or continuous with flow rates that remain the same or that alter. It is particularly advantageous that the metering of the monomers $M_2$ takes place continuously during the polymerization reaction, with flow rates that remain the same, in particular as constituent of an aqueous monomer emulsion.

Production of the aqueous dispersion of component (II) frequently makes concomitant use of dispersing agents which stabilize, in the aqueous phase, dispersion not only of the monomer droplets but also of the polymer particles obtained via the free-radical-initiated polymerization reaction, and thus ensure that the resultant aqueous polymer composition is stable. These can be not only the protective colloids usually used in the conduct of free-radical aqueous emulsion polymerization reactions, but also emulsifiers.

Examples of suitable protective colloids are polyvinyl alcohols, cellulose derivatives or copolymers comprising vinylpyrrolidone and comprising acrylic acid, for example those defined herein as component I(i). A detailed description of other suitable protective colloids is found in Houben-Weyl, Methoden der organischen Chemie [Methods of Organic Chemistry], vol. XIV/1, Makromolekulare Stoffe [Macromolecular Materials], pp. 411 to 420, Georg-Thieme-Verlag, Stuttgart, 1961.

It is also possible, of course, to use mixtures of emulsifiers and/or protective colloids. Dispersing agents frequently used comprise exclusively emulsifiers, the molecular weights of these usually being below 1000, in contrast to protective colloids. They can be either anionic, cationic, or nonionic. When mixtures of surface-active substances are used, the individual components must, of course, be compatible with one another, and in case of doubt this can be checked by a few preliminary experiments. Anionic emulsifiers are generally compatible with one another and with nonionic emulsifiers. The same also applies to cationic emulsifiers, whereas anionic and cationic emulsifiers are mostly not compatible with one another.

Examples of familiar emulsifiers are ethoxylated mono-, di-, and trialkylphenols (number of ED units: from 3 to 50, alkyl moiety: $C_4$ to $C_{12}$), ethoxylated fatty alcohols (number of EO units: from 3 to 50; alkyl moiety: $C_5$ to $C_{30}$), and also the alkali metal and ammonium salts of alkyl sulfates (alkyl moiety: $C_8$ to $C_{12}$), of sulfuric hemiesters of ethoxylated alkanols (number of EO units; from 3 to 30, alkyl moiety: $C_{12}$ to $C_{18}$), and ethoxylated alkylphenols (number of EC, units; from 3 to 50, alkyl moiety: $C_4$ to $C_{12}$, of alkylsulfonic acids (alkyl moiety: $C_{12}$ to $C_{18}$), and of alkylarylsulfonic acids (alkyl moiety: $C_9$ to $C_{18}$). Other suitable emulsifiers are found in Houben-Weyl, Methoden der organischen Chemie [Methods of Organic Chemistry], vol. XIV/1, Makromolekulare Stoffe [Macromolecular Materials], pp. 192 to 208, Georg-Thieme-Verlag, Stuttgart, 1961.

Preference is given to use of nonionic and/or anionic emulsifiers for the process of the invention.

The quantity of dispersing agent, in particular emulsifiers, used is generally from 0.1 to 5% by weight, preferably from 1 to 3% by weight, based in each case on the entirety of the monomer mixture M. If protective colloids are used as sole dispersing agents, the quantity used is markedly higher; it is usual to use from 5 to 40% by weight of dispersing agent, preferably from 10 to 30% by weight, based in each case on the entirety of the monomer mixture M.

In the invention it is optionally possible to use some of, or the entirety of, dispersing agent as initial charge in the polymerization vessel. However, it is also possible to meter the entirety or the optionally remaining residual quantity of dispersing agent into the mixture during the polymerization reaction. The manner in which the entirety or the optionally remaining residual quantity of dispersing agent is metered into the polymerization vessel here can be batchwise in one or more portions, or continuous with flow rates that remain the same or that alter. It is particularly advantageous that the metering of the dispersing agent takes place continuously during the polymerization reaction, with flow rates that remain the same, in particular as constituent of an aqueous monomer emulsion.

Preferred monomers M comprise a) from 0.01 to 50% by weight of at least one ethylenically unsaturated monomer which comprises at least one epoxy group and/or at least one hydroxyalkyl group (monomer(s) $M_1$), and b) from 50 to 99.99% by weight of at least one other ethylenically unsaturated monomer which differs from the monomers $M_1$ (monomer(s) $M_2$).

Particularly preferred polymers M of this type are obtainable via free-radical-initiated solution polymerization of from 10 to 30% by weight, preferably from 15 to 22% by weight, of acrylic and/or methacrylic esters of $C_1$- to $C_8$-alcohols—preferably methanol, n-butanol, 2-ethylhexanol—with from 40 to 70% by weight, preferably from 55 to 65% by weight, of styrene, and from 5 to 50% by weight, preferably from 20 to 30% by weight, of 2-hydroxyethyl acrylate and/or 2-hydroxyethyl methacrylate, and/or glycidyl acrylate and/or glycidyl methacrylate, where the entirety of the components is 100% by weight.

Other preferred polymers M comprise no monomer(s) $M_1$, and are obtainable via free-radical-initiated solution polymerization of from 80 to 99% by weight, preferably from 85 to 95% by weight, of acrylic and/or methacrylic esters of $C_1$- to $C_8$-alcohol—preferably methanol, n-butanol, 2-ethylhexanol—with from 0 to 5% by weight, preferably from 1 to 3% by weight, of ureidomethacrylate and from 0.5 to 5% by weight, preferably from 1 to 4% by weight, of α,β-monoethylenically unsaturated mono- and dicarboxylic acids having from 3 to 6 C atoms—preferably acrylic acid, methacrylic acid—and/or amides of these acids, where the entirety of the components is 100% by weight.

Other preferred polymers M are obtainable via use of dispersing agents based on poly(acrylic acid)(s) as described in EP-A-1240205 or DE-A-19991049592.

It is preferable that these polymers have a core-shell structure (isotropic distribution of the phases, for example resembling layers in an onion) or a Janus structure (anisotropic distribution of the phases).

It is possible in the invention for the person skilled in the art to produce, via controlled variation of type and quantity of the monomers $M_1$ and $M_2$, to produce aqueous polymer compositions with polymers M having a glass transition temperature $T_g$ or a melting point in the range from (−60) to 270° C.

Other suitable aqueous dispersions are dispersions selected from the group of the polyurethanes, the halogenated vinyl polymers, the vinyl alcohol polymers and/or vinyl ester polymers, rubber, colophony resins, and hydrocarbon resins. Dispersions of this type are obtainable commercially, an example being Vinnepas® ethylene-vinyl acetate dispersions from Wacker or Tacylon colophony resins from Eastman Chemical Company. Preference is given to aqueous dispersions of aliphatic and aromatic polyurethanes, of polyvinyl acetate homo- and copolymers, and to terpentine resins and hydrocarbon resins.

Component D)

The lignocellulose materials of the invention can comprise, as component D, other additives that are commercially available and known to the person skilled in the art, e.g. hardeners, hydrophobizing agents such as paraffin emulsions, wood preservatives, dyes, pigments, fillers, rheology aids, formaldehyde scavengers, for example urea or polyamines, flame retardants, cellulose, e.g. nanocrystalline cellulose or microfibrillated cellulose.

Microfibrillated cellulose is also termed microcellulose (cellulose) microfibrills, nanofibrillated cellulose, nanocellulose, or (cellulose) nanofibrills (Cellulose 2010, 17, 459; p. 460, right-hand column). The expression "microfibrillated cellulose" means a cellulose which has been defibrillated. That means that the individual microfibrils of the cellulose-containing fibers have been to some extent or completely separated from one another. The average fiber length of the microfibrillated cellulose is from 0.1 to 1500 μm, preferably from 1 to 1500 μm, particularly preferably from 500 to 1300 μm, and at least 15% by weight of the fibers are shorter than 200 μm.

Suitable hardeners for the organic isocyanates are any of the chemical compounds of any molecular weight which bring about or accelerate the reaction of organic isocyanate having at least two isocyanate groups with water or other compounds or substrates (for example wood) which comprise —OH or —NH, —$NH_2$, or =NH groups.

Hardeners having good suitability for organic isocyanate having at least two isocyanate groups, for example PMDI, can be divided into four groups: amines, other bases, metal salts, and organometallic compounds, preference being given to amines. These hardeners are described by way of example in Michael Szycher, Szycher's Handbook of Polyurethanes, CRC Press, 1999, pp. 10-1 to 10-20.

Other suitable compounds are those that greatly accelerate the reaction of compounds comprising reactive hydrogen atoms, in particular hydroxy groups, with the organic isocyanates. Polyols selected from the group of ethylene glycol, diethylene glycol, propylene glycol, dipropylene glycol, butanediol, glycerol, trimethylol propane, triethanolamine, pentaerythritol, sorbitol, and mixtures thereof can be used. Other suitable polyols are biopolyols, such as polyols derived from soya oil, rapeseed oil, castor oil, and sunflower oil. Other suitable materials are polyether polyols which can be obtained via polymerization of cyclic oxides, for example ethylene oxide, propylene oxide, butylene oxide, or tetrahydrofuran in the presence of polyfunctional initiators. Suitable initiators comprise active hydrogen atoms, and can be water, butanediol, ethylene glycol, propylene glycol, diethylene glycol, triethylene glycol, dipropylene glycol, ethanolamine, diethanolamine, triethanolamine, toluenediamine, diethyltoluenediamine, phenyldiamine, diphenylmethanediamine, ethylenediamine, cyclohexanediamine, cyclohexanedimethanol, resorcinol, bisphenol A, glycerol, trimethylolpropane, 1,2,6-hexanetriol, pentaerythritol, or any mixture thereof. Other suitable polyether polyols comprise diols and triols such as polyoxypropylenediols and -triols, and poly(oxyethylene-oxypropylene)diols and -triols, these being produced via simultaneous or successive addition reactions of ethylene oxides and propylene oxides with di- or trifunctional initiators. Other suitable materials are polyester polyols such as hydroxy-terminated reaction products of polyols as described above with polycarboxylic acids or polycarboxylic acid derivatives, e.g. anhydrides thereof, in particular dicarboxylic acids or dicarboxylic acid derivatives, for example succinic acid, dimethyl succinate, glutaric acid, dimethyl glutarate, adipic acid, dimethyl adipate, sebacic acid, phthalic anhydride, tetrachlorophthalic anhydride, or dimethyl terephthalate, or a mixture thereof.

It is advantageous to use, as hardener, basic polyurethane catalyst, for example tertiary amines such as triethylamine, tributylamine, dimethylbenzylamine, dicyclohexylmethylamine, dimethylcyclohexylamine, N,N,N',N'-tetramethyldiaminodiethyl ether, bis(dimethylaminopropyl)urea, N-methyl and N-ethylmorpholine, N-cyclohexylmorpholine, N,N,N',N'-tetramethylethylenediamine, N,N,N',N'-tetramethylbutanediamine, N,N,N',N'-tetramethylhexane-1,6-diamine, pentamethyldiethylenetriamine, dimethylpiperazine, N-dimethylaminoethylpiperidine, 1,2-dimethylimidazole, 1-azabicyclo[2.2.0]octane, 1,4-diazabicyclo[2.2.2]octane (Dabco) and alkanolamine compounds such as triethanolamine, triisopropanolamine, N-methyl- and N-ethyldiethanolamine, dimethylaminoethanol, 2-(N,N-dimethylaminoethoxy)ethanol, N,N',N"-tris(dialkylaminoalkyl)hexahydrotriazine, e.g. N,N',N"-tris(dimethylaminopropyl)-s-hexahydrotriazine, and triethylenediamine.

Suitable metal salts are metal salts such as iron(II) chloride, zinc chloride, lead octoate, and preferably tin salts such as tin dioctoate.

Suitable organometallic compounds are organometallic salts such as tin dioctoate, tin diethylhexoate, and dibutyltin dilau rate, and also in particular mixtures of tertiary amines and organic tin salts.

Other suitable bases are amidines such as 2,3-dimethyl-3,4,5,6-tetrahydropyrimidine, tetraalkylammonium hydroxides such as tetramethylammonium hydroxide, alkali metal hydroxides such as sodium hydroxide, and alkali metal alcoholates such as sodium methanolate and potassium isopropanolate, and also alkali metal salts of long-chain fatty acids having from 10 to 20 C atoms and optionally pendent OH groups.

Suitable hardeners for aminoplastic resins or phenol-formaldehyde resins (optional component C) are those which catalyze further condensation, for example acids or salts of these, or aqueous solutions of said salts.

Suitable acids are inorganic acids such as HCl, HBr, HJ, $H_2SO_3$, $H_2SO_4$, phosphoric acid, polyphosphoric acid, nitric acid, sulfonic acids, such as p-toluenesulfonic acid, methanesulfonic acid, trifluoromethanesulfonic acid, nonafluorobutanesulfonic acid, carboxylic acids such as $C_1$- to $C_8$-carboxylic acids, e.g. formic acid, acetic acid, propionic acid, or a mixture of these, preferably inorganic acids such as HCl, $H_2SO_3$, $H_2SO_4$, phosphoric acid, polyphosphoric acid, nitric acid, sulfonic acids such as p-toluenesulfonic acid, methanesulfonic acid, carboxylic acids such as $C_1$- to $C_8$-carboxylic acids, e.g. formic acid, acetic acid, particularly preferably inorganic acids such as $H_2SO_4$, phosphoric acid, nitric acid, sulfonic acids such as p-toluenesulfonic acid, methanesulfonic acid, carboxylic acids such as formic acid, acetic acid.

Suitable salts are halides, sulfites, sulfates, hydrogensulfates, carbonates, hydrogencarbonates, nitrites, nitrates, sulfonates, salts of carboxylic acids, for example formates, acetates, propionates, preferably sulfites, carbonates, nitrates, sulfonates, salts of carboxylic acids, for example formates, acetates, propionates, particularly preferably sulfites, nitrates, sulfonates, salts of carboxylic acids, for example formates, acetates, propionates, of protonated, primary, secondary, and tertiary aliphatic amines, alkanolamines, cyclic, aromatic amines such as $C_1$- to $C_8$-amines, isopropylamine, 2-ethylhexylamine, di(2-ethylhexyl)amine, diethylamine, dipropylamine, dibutylamine, diisopropylamine, tert-butylamine, triethylamine, tripropylamine, triisopropylamine, tributylamine, monoethanolamine, morpholine, piperidine, pyridine, and also ammonia, preferably of protonated primary, secondary, and tertiary aliphatic amines, alkanolamines, cyclic amines, cyclic aromatic amines, and also ammonia, particularly preferably of protonated alkanolamines, cyclic amines, and also ammonia, or a mixture of these. Particular preference is given to ammonium salts, for example ammonium nitrate and ammonium sulfate. Phenol-formaldehyde resins can also be hardened by an alkaline route, preferably by carbonates or hydroxides, for example potassium carbonate and sodium hydroxide.

Other examples of hardeners for aminoplastic resins are found in M. Dunky, P. Niemz, Holzwerkstoffe und Leime [Wood-based Materials and Glues], Springer 2002, pp. 265 to 269, these hardeners for phenol-formaldehyde resins are found in M. Dunky, P. Niemz, Holzwerkstoffe und Leime, Springer 2002, pp. 341 to 352, and these hardeners for organic isocyanates having at least 2 isocyanate groups are found in M. Dunky, P. Niemz, Holzwerkstoffe und Leime, Springer 2002, pp. 385 to 391.

Component E)

Component E) are plastics particles, optionally expanded.

Plastic particles are by way of example polymer particles, preferably thermoplastic polymer particles.

It is preferable to use expandable or expanded plastics particles, preferably expanded thermoplastic particles. Expanded plastics particles are produced from expandable plastics particles, preferably expandable thermoplastic particles. Both are based on, or are composed of, polymers, preferably thermoplastic polymers, where these can be foamed. These are known to the person skilled in the art.

Polymers of this type having good suitability for unexpanded, expandable, and expanded polymer particles are by way of example polyketones, polysulfones, polyoxymethylene, PVC (rigid and flexible), polycarbonates, polyisocyanurates, polycarbodiimides, polyacrylimides and polymethacrylimides, polyamides, polyurethanes, aminoplastic resins and phenolic resins, styrene homopolymers (hereinafter also termed "polystyrene" or "styrene polymer"), styrene copolymers, $C_2$-$C_{10}$-olefin homopolymers, $C_2$-$C_{10}$-olefin copolymers, polyesters, or a mixture of these, preferably PVC (rigid and flexible), polyurethanes, styrene homopolymer, styrene copolymer, or a mixture of these, particularly preferably styrene homopolymer, styrene copolymer, or a mixture of these, in particular styrene homopolymer, styrene copolymer, or a mixture of these.

The preferred or particularly preferred expandable styrene polymers or expandable styrene copolymers described above have a relatively small content of blowing agent. Polymers of this type are also described as "having low blowing agent content". A process having good suitability for the production of expandable polystyrene or styrene copolymer having low blowing agent content is described in U.S. Pat. No. 5,112,875, which is expressly incorporated herein by way of reference.

As described, it is also possible to use styrene copolymers. These styrene copolymers advantageously have at least 50% by weight of styrene incorporated in the polymer, preferably at least 80% by weight. Examples of comonomers that can be used are α-methylstyrene, ring-halogenated styrenes, acrylonitrile, acrylic or methacrylic esters of alcohols having from 1 to 8 C atoms, N-vinylcarbazole, maleic acid, maleic anhydride, (meth)acrylamides, and/or vinyl acetate.

The polystyrene and/or styrene copolymer can advantageously comprise a small quantity of a chain-branching agent incorporated into the polymer, i.e, of a compound having more than one, preferably two, double bonds, for example divinylbenzene, butadiene, and/or butanediol diacrylate. The quantities used of the branching agent are generally from 0.0005 to 0.5 mol %, based on styrene.

Mixtures of various styrene (co)polymers can also be used.

Styrene homopolymers or styrene copolymers having good suitability are glassclear polystyrene (GPPS), high-impact polystyrene (HIPS), anionically polymerized polystyrene or high-impact polystyrene (AIPS), styrene-α-methylstyrene copolymers, acrylonitrile-butadiene-styrene polymers (ABS), styrene-acrylonitrile (SAN), acrylonitrile-styrene-acrylate (ASA), methyl acrylate-butadiene-styrene (MBS), methyl methacrylate-acrylonitrile-butadiene-styrene (MABS) polymers, and mixtures thereof or with polyphenylene ether (PPE).

Preference is given to styrene polymers, styrene copolymers, or styrene homopolymers with molar mass in the range from 70 000 to 400 000 g/mol, particularly from 190 000 to 400 000 g/mol, very particularly preferably from 210 000 to 400 000 g/mol.

This type of polystyrene and/or styrene copolymer can be produced by any of the polymerization processes known to the person skilled in the art, see by way of example Ullmann's Encyclopedia, sixth edition, 2000 Electronic Release, or Kunststoff-Handbuch [Plastics Handbook] 1996, vol. 4 "Polystyrol" [Polystyrene], pp. 567 to 598.

If the expanded plastics particles are composed of different polymer types, i.e. polymer types based on different monomers, for example polystyrene and polyethylene, or polystyrene and homopolypropylene, or polyethylene and homopolypropylene, these can be present in different ratios by weight, which however are not critical.

The form in which the expanded plastics particles are used is generally that of spheres or beads with average diameter from 0.25 to 10 mm, preferably from 0.4 to 8.5 mm, particularly preferably from 0.4 to 7 mm, in particular in the range from 1.2 to 7 mm, and they advantageously have a small surface-to-volume ratio, for example taking the form of a spherical or ellipsoidal particle.

It is advantageous that the expanded plastics particles have closed cells. The open-cell factor is generally less than 30% in accordance with DIN ISO 4590.

The bulk density of the expanded plastics particles is from 10 to 150 kg/m$^3$, preferably from 30 to 100 kg/m$^3$, particularly preferably from 40 to 80 kg/m$^3$, in particular from 50 to 70 kg/m$^3$. The bulk density is usually determined via weighing of a defined volume filled with the loose material.

The residual content of blowing agent in the expanded plastics particles is generally either zero or small. The content of blowing agent in the expanded plastics particles is generally in the range from 0 to 5.5% by weight, preferably from 0 to 3% by weight, with preference from 0 to 2.5% by weight, with particular preference from 0 to 2% by weight, based in each case on the expanded polystyrene or expanded styrene copolymer. The expression "0% by weight" here means that the usual detection methods cannot detect any blowing agent.

Said expanded plastics particles can be used without or with, preferably without, further measures for reduction of blowing agent content, and particularly preferably without further intermediate steps for the production of the lignocellulose-containing material.

The expandable polystyrene or expandable styrene copolymer, or the expanded polystyrene or expanded styrene copolymer, usually has an antistatic coating.

The expanded plastics particles can be obtained as follows:

Compact expandable plastics particles, usually solids which generally have no cell structure, which comprise an expandable medium (also termed "blowing agent") are expanded via exposure to heat or to pressure change (another term often used being "foaming"). The blowing agent expands here, and the size of the particles increases, and cell structures are produced.

This expansion is generally carried out in conventional foaming apparatuses, often termed "prefoamers". These prefoamers can be fixed installations or else can be mobile.

The expansion can be single-stage or multistage expansion. In the single-stage process, the expandable plastics particles are generally simply expanded to the desired final size.

In the multistage process, the expandable plastics particles are generally first expanded to an intermediate size and then, in one or more further stages, expanded by way of an appropriate number of intermediate sizes to the desired final size.

It is preferable that the expansion is single-stage expansion.

The procedure for the production of expanded polystyrene as component E) and/or of expanded styrene copolymer as component E) is generally that the expandable styrene homopolymers or expandable styrene copolymers are expanded in a known manner via heating to temperatures above their softening point, for example using hot air or preferably steam and/or pressure change (another term often used being "foamed") as described by way of example in Kunststoff Handbuch [Plastics Handbook] 1996, vol. 4 "Polystyrol" [Polystyrene], Hanser 1996, pp. 640 to 673 or U.S. Pat. No. 5,112,875. The expandable polystyrene or expandable styrene copolymer is generally obtainable as described above in a manner known per se via suspension polymerization or by means of extrusion processes. The blowing agent expands here, and the size of the polymer particles increases, and cell structures are produced.

The expandable polystyrene and/or styrene copolymer is generally produced in a manner known per se via suspension polymerization or by means of extrusion processes.

In suspension polymerization, styrene is polymerized by means of free-radical-generating catalysts in aqueous suspension in the presence of a conventional suspension stabilizer, optionally with addition of other comonomers. The blowing agent and optionally other added substances here can be used concomitantly as initial charge in the polymerization reaction, or can be added to the mixture during the course of the polymerization reaction or after the polymerization reaction has ended. After the polymerization reaction has ended, the resultant bead-shaped, blowing-agent-impregnated, expandable styrene polymers are separated from the aqueous phase, washed, dried, and sieved.

In the extrusion process, the blowing agent is incorporated by mixing into the polymer for example by way of an extruder, conveyed through a die plate, and granulated under pressure to give particles or strands.

The resultant expanded plastics particles or the coated expanded plastics particles can be placed into intermediate storage and transported.

Suitable blowing agents are any of the blowing agents known to the person skilled in the art, for example aliphatic $C_3$- to $C_{10}$-hydrocarbons such as propane, n-butane, isobutane, n-pentane, isopentane, neopentane, cyclopentane, and/or hexane and its isomers, alcohols, ketones, esters, ethers, halogenated hydrocarbons, or a mixture of these, preferably n-pentane, isopentane, neopentane, cyclopentane, or a mixture of these, particularly preferably commercially available pentane isomer mixtures of n-pentane and isopentane.

The content of blowing agent in the expandable plastics particle is generally in the range from 0.01 to 7% by weight, preferably from 0.01 to 4% by weight, with preference from 0.1 to 4% by weight, with particular preference from 0.5 to 3.5% by weight, based in each case on the expandable polystyrene or styrene copolymer comprising blowing agent.

Component F)

Component F) is compounds selected from the group of the surfactants, the release agents, the binders (component C), the polyamines, or the polyols.

The concentration of component F) in water is generally from 0.01 to 75% by weight, preferably from 1 to 60% by weight, particularly preferably from 2 to 50% by weight.

Suitable surfactants are nonionic, anionic, cationic, or amphoteric surfactants. Examples of suitable surfactants are fatty alcohol polyglycol ethers, fatty alcohol sulfates, sulfonated fatty alcohol polyglycol ethers, fatty alcohol ether sulfates, sulfonated fatty acid methyl esters, sugar surfactants, such as alkyl glycosides, alkylbenzenesulfonates, alkanesulfonates, methyl ester sulfonates, quaternary ammonium salts, such as cetyltrimethylammonium bromide, and soaps.

Suitable release agents are fatty acids and salts of these, for example zinc stearate, or paraffins, waxes, and fats, modified polysiloxanes, or silicone oils.

Suitable binders are the binders described in component C.

Suitable polyamines are ethylenediamine, toluenediamine, diaminodiphenylmethane, polymethylene polyphenyl polyamines, polyethyleneimine, or polyvinylamine, amino alcohols such as ethanolamine, diethanolamine, and mixtures of various polyamines, preferably polyethyleneimine or polyvinylamine, or a mixture of these.

The molar mass of the polyamines is generally at least 800 g/mol, where these have at least 6, preferably at least 8, particularly preferably at least 10, primary or secondary amino groups.

The average molar mass of the polyvinylamines is generally from 5000 to 500 000 g/mol, preferably from 5000 to 350 000 g/mol, particularly preferably from 5000 to 100 000 g/mol, The average molar mass of the polyethyleneimines is advantageously from 500 to 100 000 g/mol, preferably from 500 to 70 000 g/mol, particularly preferably from 500 to 50 000 g/mol, in particular from 500 to 20 000 g/mol.

Suitable polyols are the polyols already described in component B).

The lignocellulose materials produced by the process of the invention generally take the form of boards and have a density of from 300 to 1200 kg/m$^3$, preferably from 400 to 850 kg/m$^3$, particularly preferably from 500 to 700 kg/m$^3$.

They are preferably particleboard, fiberboard, for example HDF (high density fiberboard), MDF (medium density fiberboard), or OSB (oriented strand board). Particular preference is given to particleboard. In one particularly preferred embodiment said particleboard has a three-layer structure.

The lignocellulose materials produced by the process of the invention, in particular three-layer particleboard, feature low formaldehyde emission and at the same time high quality, in particular mechanical strength. The high quality is ensured by virtue of the fact that, despite the low initial adhesion of isocyanate binders, the process produces very stable mats which are not damaged in transit to the hot press (e.g. during transfer from one conveyor belt to the next). The expression "stable mat" is used when, at an advance rate of from 5 to 75 m/min, the mat resists deformation (break-off or crumpling) in an unsupported gap measuring 7 cm, or when values of at least 4 cm, preferably at least 5 cm, particularly preferably at least 6 cm, in particular at least 7 cm, are obtained in what is known as the push-off test.

The test known as the push-off test is carried out by analogy with that in paragraph [00130] of WO-A-2012/018934. After the step ii.) here, the mat is placed on a test table in such a way that one end of the mat is flushed with the table edge. The mat is then pushed at a constant advance rate of 15 cm/min over the table edge until gravity causes break-off of the mat. A ruler accompanying the material is used to measure the length of the projecting mat prior to break-off. The greater the projecting length, the higher the stability of the mat. The values are stated in cm and are rounded upward or downward to the nearest cm.

The lignocellulose materials produced by the process of the invention, in particular three-layer particleboard, are used mainly in construction, in the fitting-out of interiors, in shop fitting and the construction of exhibition stands, as materials for furniture, and as packaging material.

Examples of uses of the lignocellulose materials produced in the invention in construction, in the fitting-out of interiors, and in shop fitting and the construction of exhibition stands are roof paneling and wall paneling, infill, shuttering, floors, partitions, shelving, or as internal layers for doors.

Examples of uses of the lignocellulose materials produced in the invention in furniture construction are support material for unit furniture, shelving, door material, worktop, kitchen front, outer layers in sandwich structures, as elements in tables and chairs, and upholstered furniture.

EXAMPLES

1a) Material mixture for the outer layers (mixture 1)

99 g of Lupranat® M20 S (BASF Polyurethanes GmbH) and 225 g of water were added successively to 3392 g of outer layer particles (moisture content 2.8%) and mixed in a paddle mixer.

1b) Material mixture for the middle layers (mixture 2)

99 g of Lupranat® M20 S (BASF Polyurethanes GmbH) and 168 g of water were added successively to 3458 g of middle layer particles (moisture content 4.8%) and mixed in a paddle mixer.

2) Production of the Particle Mats

A mat composed of three layers was scattered into a scattering frame. The lowermost layer (outer layer) of mixture 1, the middle layer (core) of mixture 2, and the upper layer (outer layer) of mixture 1 in a mass ratio of 16.5:67:16.5 (total weight of the mat 2370 g). The scattered mat was precompressed in the scattering frame in a downstroke press at room temperature 60 seconds at a specific pressure of 10 bar. This precompressed the mat to a thickness of 40 mm. Subsequently, the scattering frame was removed. To monitor the temperature profile in the middle of the board (middle layer temperature), an optical sensor was introduced into a horizontal hole in the center of the middle layer in the narrow face of the mat. Subsequently, the mat was provided with separation fabrics on the upper and lower sides and compressed to a thickness d in an HLOP 170 high-frequency press from Hoefer Presstechnik GmbH and then heated by applying a high-frequency alternating field (27.12 MHz) to a middle layer temperature of T within a time t. The anode current was chosen such that the target temperature T was attained within the time t. After the attainment of the target temperature, the high-frequency press was opened. In this way, two or three identical particle mats were produced in each case. The first mat was used to conduct a push-off test (3.1); the second was used in order to produce a particleboard after automatic transfer into a hot press during which a gap was surmounted (3.2), and the third was produced and used in the cases where it was not possible to surmount that gap without damage. The third mat was then transferred into a hot press without automatic transfer, in order to produce a particleboard (3.2).

3.1 Push-Off Test

The mat was placed on a test table in such a way that one end of the mat was flushed with the table edge. The mat was then pushed at a constant advance rate of 15 cm/min over the table edge until gravity caused break-off of the mat. A ruler accompanying the material was used to measure the length of the projecting mat prior to break-off. The values were rounded upward or downward to the nearest cm.

3.2 Production of the Particleboards

The mat was pushed by means of an automatic transfer system with an advance rate of 9 m/min into an HLOP 350 hot press from Hoefer Presstechnik GmbH, In the course of this, the self-supporting mat had to surmount a gap of 7 cm. The stability of the mat was assessed according to the following criteria:

| Mat assessment (gap) | Criteria |
|---|---|
| 1 | Mat surmounts the gap and remains stable |
| 2 | Slight material loss when surmounting the gap, no deformation |
| 3 | Slight deformation of the mat and slight material loss when surmounting the gap |
| 4 | Mat is completely destroyed and cannot surmount the gap |

The mats of assessment levels 1 and 2, after being transferred automatically into the hot press, were pressed at a temperature of 220° C. to a thickness of 16 mm (pressing time 123 s). The transverse tensile strengths of the three-layer particieboards thus produced were determined according to EN 319, and the densities to EN 1058.

The mats of assessment levels 3 and 4 were subsequently produced once again and pressed without automatic transfer (i.e. without guiding the mat across the 7 cm gap) in the hot press at a temperature of 220° C. to a thickness of 16 mm (pressing time 123 s). The transverse tensile strength of the three-layer particleboards thus produced was determined according to EN 319, and the densities according to EN 1058.

4. Test Results

| Test | Reference[a)] | 1 | 2 | 3 | 4 | 5 | 6 | 7 | 8 | 9 |
|---|---|---|---|---|---|---|---|---|---|---|
| Thickness d [mm] | — | 39 | 33 | 26 | 26 | 26 | 26 | 26 | 26 | 26 |
| Time t [s] | — | 90 | 83 | 90 | 65 | 47 | 39 | 36 | 19 | 42 |
| Temperature T [° C.] | — | 81 | 68 | 74 | 74 | 77 | 76 | 77 | 55 | 90 |
| Mat assessment (gap) | 4 | 4 | 2 | 1 | 1 | 1 | 1 | 1 | 3 | 1 |
| Push-off test [cm] | 1 | 2 | 4 | 6 | 6 | >7 | >7 | >7 | 4 | >7 |
| Density of particleboard [kg/m$^3$] | 673 | 689 | 690 | 682 | 693 | 663 | 655 | 646 | 650 | 682 |
| Transverse tensile strength of particleboard [N/mm$^2$] | 0.53 | 0.59 | 0.72 | 0.70 | 0.66 | 0.58 | 0.62 | 0.45 | 0.69 | 0.22 |

[a)]without compaction and heating in the high-frequency press

The invention claimed is:

1. A process for the production of isocyanate-bound lignocellulose materials, the process comprising:

mixing:

A) lignocellulose-containing particles or fibers,

B) organic isocyanate having at least two isocyanate groups or a mixture of these, C) optionally binders selected from the group of the phenol-formaldehyde resins, the aminoplastic resins, the protein-based binders, and other polymer-based binders, and mixtures of these, D) optionally additives or a mixture of these, and E) optionally plastics particles or a mixture of these, to form a mixture i.) scattering the resultant mixture to give a mat, ii.) precompacting and heating the mat during or after the precompaction process, and iii.) hot pressing, wherein, in the step ii.), operations are carried out at elevated temperature of from 55 to 90° C. during and/or after the precompaction process, the mat, at the juncture at which the final heating temperature is reached in the center of the mat, the mat has a height of from 27.5 to 60% of the height of the mat immediately after the scattering of the mat, and a push-off value of at least 4 cm.

2. The process for the production of isocyanate-bound lignocellulose materials according to claim 1, wherein from 65 to 99% by weight of one or more lignocellulose-containing particles or fibers (component A) are mixed with B) from 1 to 10% by weight of one or more organic isocyanates having at least two isocyanate groups, or a mixture of these (component B), C) from 0 to 5% by weight of binders selected from the group of the phenol-formaldehyde resins, the aminoplastic resins, the protein-based binders, and other polymer-based binders, and mixtures of these (component C), D) from 0 to 10% by weight of additives or a mixture of these (component D), E) from 0 to 10% by weight of plastics particles or a mixture of these (component E), in any desired sequence.

3. The process for the production of isocyanate-bound lignocellulose materials according to claim 1, wherein the isocyanate-containing Lignocellulose materials are medium-density fiberboard, high-density fiberboard, particleboard, or oriented strand boards.

4. The process for the production of isocyanate-bound lignocellulose materials according to claim 1, wherein the isocyanate-containing lignocellulose materials are single- or multilayer particle- or fiberboard.

5. The process for the production of isocyanate-bound lignocellulose materials according to claim 1, wherein the isocyanate-containing lignocellulose materials are single- or multilayer particleboard.

6. The process for the production of isocyanate-bound lignocellulose materials according to claim 1, wherein the isocyanate-containing lignocellulose materials are three-layer particleboard.

7. The process for the production of isocyanate-bound lignocellulose materials according to claim 6, wherein the underside and/or upper side of the mat is brought into contact, before or during the step ii.), with water or an aqueous solution, emulsion, or suspension of a component F).

8. The process for the production of isocyanate-bound lignocellulose materials according to claim 6, wherein the underside and upper side are brought into contact with water or an aqueous solution, emulsion, or suspension of a component F).

9. The process for the production of isocyanate-bound lignocellulose materials according to claim 1, wherein, in step ii.), operations are carried out at elevated temperature of from 60 to 80° C. during and/or after the precompaction process.

10. The process for the production of isocyanate-bound lignocellulose materials according to claim 1, wherein, in step ii.), operations are carried out at elevated temperature of from 65 to 80° C. during and/or after the precompaction process.

11. The process for the production of isocyanate-bound lignocellulose materials according to claim 1, wherein in the step ii.) during and/or after the precompaction process the temperature in the center of the mat is at least 55° C.

12. The process for the production of isocyanate-bound lignocellulose materials according to claim 1, wherein in the step ii.) during and/or after the precompaction process the temperature in the center of the mat is at least 60° C.

13. The process for the production of isocyanate-bound lignocellulose materials according to claim 1, wherein in the step ii.) during and/or after the precompaction process the temperature in the center of the mat is at least 65° C.

14. The process for the production of isocyanate-bound lignocellulose materials according to claim 1, wherein in the step ii.) during and/or after the precompaction process the temperature in the center of the mat is at most 90° C.

15. The process for the production of isocyanate-bound lignocellulose materials according to claim 1, wherein in the step ii.) during or after the precompaction of the mat, at the juncture at which the final heating temperature is achieved in the center of the mat, the height of the mat is from 30 to 50% of the height of the mat immediately after the scattering of the mat.

16. The process for the production of isocyanate-bound lignocellulose materials according to claim 1, wherein in the step ii.) the heat is introduced within a period of 60 seconds to reach the elevated temperature.

17. The process for the production of isocyanate-bound lignocellulose materials according to claim 1, wherein the density of the isocyanate-containing lignocellulose materials is from 300 to 1200 kg/m$^3$.

18. Wall paneling, infill, shuttering, floors, partitions, shelving, or internal layers for doors comprising isocyanate-bound lignocellulose materials produced according to claim 1.

19. The process for the production of isocyanate-bound lignocellulose materials according to claim 1, wherein from 80 to 98.5% by weight of one or more lignocellulose-containing particles or fibers (component A) are mixed with B) from 1.5 to 5% by weight of one or more organic isocyanates having at least two isocyanate groups, or a mixture of these (component B), C) from 0 to 4% by weight of binders selected from the group of the phenol-formaldehyde resins, the aminoplastic resins, the protein-based binders, and other polymer-based binders, and mixtures of these (component C), D) from 0.5 to 8% by weight of additives or a mixture of these (component D), E) from 0 to 8% by weight of plastics particles or a mixture of these (component E), in any desired sequence.

20. The process for the production of isocyanate-bound lignocellulose materials according to claim 1, wherein from 85 to 98.25% by weight of one or more lignocellulose-containing particles or fibers (component A) are mixed with B) from 1.75 to 4% by weight of one or more organic isocyanates having at least two isocyanate groups, or a mixture of these (component B), C) from 0 to 3% by weight of binders selected from the group of the phenol-formaldehyde resins, the aminoplastic resins, the protein-based binders, and other polymer-based binders, and mixtures of these (component C), D) from 1 to 6% by weight of additives or a mixture of these (component D), E) from 0.5 to 6% by weight of plastics particles or a mixture of these (component E), in any desired sequence.

21. The process for the production of isocyanate-bound lignocellulose materials according to claim 1, wherein from 90 to 98% by weight of one or more lignocellulose-containing particles or fibers (component A) are mixed with B) from 2 to 3.5% by weight of one or more organic isocyanates having at least two isocyanate groups, or a mixture of these (component B), C) from 0 to 2% by weight of binders selected from the group of the phenol-formaldehyde resins, the aminoplastic resins, the protein-based binders, and other polymer-based binders, and mixtures of these (component C), D) from 2 to 5% by weight of additives or a mixture of these (component D), E) from 1 to 5% by weight of plastics particles or a mixture of these (component E), in any desired sequence.

* * * * *